United States Patent [19]

Zettner

[11] Patent Number: 4,890,990

[45] Date of Patent: Jan. 2, 1990

[54] ROTARY INTERNAL COMBUSTION ENGINE WITH MUTUALLY INTERENGAGING ROTATABLE ELEMENTS

[76] Inventor: Michael L. Zettner, Nelkenstrasse 3, 8500 Nürnberg 70, Fed. Rep. of Germany

[21] Appl. No.: 181,356

[22] Filed: Apr. 14, 1988

Related U.S. Application Data

[63] Continuation-in-part of Ser. No. 66,357, May 7, 1987, abandoned.

[30] Foreign Application Priority Data

Oct. 2, 1985 [WO] PCT Int'l Appl. ..... PCT/EP85/00513

[51] Int. Cl.[4] ..... F01C 1/356; F01C 1/344; F01C 21/08; F01C 21/10

[52] U.S. Cl. ..... 418/173; 418/174; 418/248; 418/266

[58] Field of Search ..... 418/173, 174, 177, 181, 418/244, 248, 141, 260, 266, 243, 150; 123/237, 244, 248

[56] References Cited

U.S. PATENT DOCUMENTS

| | | | |
|---|---|---|---|
| 1,442,198 | 1/1923 | Utley | 418/150 |
| 1,625,233 | 4/1927 | Williams | 418/96 |
| 1,770,141 | 7/1930 | Meyer | 418/248 |
| 1,859,618 | 5/1932 | Cleland | 418/266 X |
| 2,796,030 | 6/1957 | Nebel | 418/150 |
| 3,181,512 | 5/1965 | Hapeman | 123/243 |
| 3,249,096 | 5/1966 | Franceschini | 418/260 X |
| 4,243,006 | 1/1981 | Quiroga | 418/260 X |
| 4,561,834 | 12/1985 | Poss | 418/181 X |

FOREIGN PATENT DOCUMENTS

| | | |
|---|---|---|
| 113697 | 3/1918 | United Kingdom . |
| 1349521 | 4/1974 | United Kingdom . |

*Primary Examiner*—John J. Vrablik
*Assistant Examiner*—Leonard P. Walnoha
*Attorney, Agent, or Firm*—Sughrue, Mion, Zinn, Macpeak & Seas

[57] ABSTRACT

A rotary engine in which the expansion pressure of a working gas is converted into a mechanical rotary movement consists of an inner engine element with an outer circumferential surface and an outer engine element which surrounds the inner element and has an inner circumferential surface, the two surfaces being disposed closely adjacent and facing each other. Disposed at, for example, the inner surface are three spaced projections, which transmit the expansion pressure of the gas to the inner element, and three expansion chambers between the projections. Four reaction members, which are each movable into the expansion chambers in turn and transmit the gas expansion pressure to the outer element, are mounted at the circumferential surface of the outer element. The two circumferential surfaces have the form of complementary annular surfaces, wherein in cross-section the inner surface has the shape of a concave, parabola-like curve and the outer surface the shape of a convex, parabola-like curve. The surfaces extend parallel to each other with close sliding fit up to their outer edges.

14 Claims, 10 Drawing Sheets

ROTARY INTERNAL COMBUSTION ENGINE WITH MUTUALLY INTERENGAGING ROTATABLE ELEMENTS

This application is a continuation-in-part of Application No. 066,357 of May 7, 1987, now abandoned.

The present invention relates to a rotary engine in which the expansion pressure of a working gas is converted into a mechanical rotary movement.

There are already numerous designs of rotary engines. A significant group of these engines is distinguished by the presence of two relatively rotatable engine parts which are mounted on a common axis and between which an annular space is present, the space being interrupted by one or more movable components and one or more stationary components. In this case, the movable components are connected to one of the engine parts and the stationary components to the other engine part. The annular space-viewed in circumferential direction—is thereby divided into smaller spaces so that an expansion chamber of variable volume is created between each stationary component and movable component. The expansion of the working gas takes place in these chambers, which each have the form of an annular segment. The gas can be hot combustion gas, steam, compressed air or any other kind of suitable expansion medium.

In the afore-described engine design, the expansion chamber corresponds to the cylinder of a reciprocating piston engine. To achieve operating efficiency of a rotary engine of that kind, however, it is necessary for each expansion chamber to be sealed off outwardly in both circumferential direction and radial direction to prevent escape of the gas. In a reciprocating engine, there are no significant problems in sealing the round piston relative to the round cylinder. This sealing is effected by means of one or more piston rings with appropriate bias to compensate for different rates of temperature expansion of the constituent materials. Such piston rings can even be dispensed with in the case of appropriately small piston cross-section. With a rotary engine, however, it is necessary to deal not with an uninterrupted cylinder surface, but with an interrupted surface.

Appreciable difficulties in this connection have been encountered in the case of the "Wankel" engine, particularly at the zones of convergence of edges to be sealed, but the problem of sealing is present in all known rotary engines. This is discussed in detail below in connection with seven examples of known engine designs:

In German (Federal Republic) patent specification No. 2 83 368 (Schroeder) there is described a rotary engine with a cylinder-like rotor and an annular stator surrounding the rotor. Slides are mounted at the inside of the stator and can be pushed back into the stator by abutments on the rotor. Segment-shaped recesses are present in the circumferential surface of the rotor as expansion chambers, at one end of which is arranged a combustion chamber and the other end of which forms a cam to push the slides into the stator. This rotary engine has the disadvantage that the slide must be sealed relative to both the stator and the rotor. Since the expansion chamber has a rectangular shape as viewed in cross-section, the sealing of the slide involves sealing of sharp edges. This is not possible with lasting effect.

U.S. Pat. specification No. 12 39 853 (Walter) discloses an engine which operates on the same principle as the engine according to the afore-described German (Fed. Rep.) specification No. 2 83 368. Combustion gases flow by way of a plate valve into an annular combustion chamber. A slide is lifted into and out of the expansion space by way of an external lever. Here, too, the expansion chamber has a rectangular cross-section so that the necessity of achieving a seal at edges again arises.

In U.S. Pat. specification No. 14 78 378 (Brown) there is described a rotary engine in which it has been attempted, by way of an annularly shaped construction of the expansion chamber and an abutment or piston, to eliminate the sealing problems connected with edges. The result, however, is merely that the sealing problems have been shifted, as the wall of the expansion chamber is not fully circularly shaped, and the stator encompasses the piston from both sides with acutely angled edges. These edges form—viewed in circumferential direction—unsealable passages in the shape of circular segments between the spaces in front of and behind the piston rings.

U.S. Pat. specification No. 37 12 273 (Thomas) describes an engine in which, in axial section, it is evident that the stator has sharp edges projecting as circular segments into the rotor. These sharp edges—viewed in circumferential direction—are unsealable. This means that the compression space for the working gas in front of the rotating piston cannot be sealed from the space behind the piston.

German (Fed. Rep.) laid-open specification No. 24 29 553 (Wenzel) describes a rotary piston engine which has inlet and outlet openings and a rotor provided with a sealing strip at an abutment thereof, the rotor being mounted on a drive shaft in a housing. The outlet openings are controlled by flaps. The housing and the rotor, with the exception of the abutment, have substantially cylindrical, mutually opposite surfaces between which is formed a circularly cylindrical annular space. A controlled sealing element, blocking a compression space, is movable in this annular space. Viewed in an axial section, this space has a rectangular cross-section, which means that both the sealing element and the abutment have at least two edges to be sealed. The simultaneous sealing of these edges in both circumferential direction and radial direction is not possible with lasting effect.

European published specification No. 0 080 070 A1 (Zettner) describes a combustion engine with a circular rotor and an annular stator which surrounds the rotor and is so constructed that recesses, forming combustion chambers, are present in the circumferential surface of the rotor. At one end of each recess is a combustion chamber and at the other end is a cam. Mounted at the inside of the stator are flaps which are pivotable into the recesses of the rotor for the absorption of the force of the expanding combustion gas and which are pivotable back into the stator by the cams. In this rotary engine, too, the expansion chamber has—viewed in axial section—a rectangular shape with the consequence that rectangular edges, to be sealed off in circumferential direction and in radial direction, are present at the cams as well as at the flaps. The simultaneous sealing of these edges in circumferential direction and radial direction is not possible in durable manner.

In U.S. Pat. specification No. 32 49 096 (Franceschini), there is disclosed an engine in which the stator circumference is eccentric relative to that of the rotor, the latter being equipped with radial vanes. The eccentricity of the rotor and stator circumferences precludes the presence of a sealing system between the circumferential surfaces as such. Sealing of the vanes relative to the surrounding stator takes place in a region in which their respective surfaces, in cross-section, are defined by an arc and two parallel lines. This parallel arrangement imposes constraints on how closely the vane surface can approach that of the stator and has the further effect that thermal expansion of the two components can significantly vary the tolerance between the surfaces. In particular, it has been experimentally established that heat-induced distortion in this parallel arrangement causes loss of sealing effect and consequent reduction in engine efficiency.

Other examples of rotary engines are described in U.S. Pat. specifications Nos. 14 42 198 (Utley), 16 25 233 (Williams) and 27 96 030(Nebel).

It is therefore the principal objection of the invention to provide a sealing system for a rotary engine with an expansion chamber which, viewed in circumferential direction, is bounded by a stationary component and a movable component, which sealing system has a wear characteristic at least comparable with the piston sealing system in a reciprocating engine and does not negatively influence engine efficiency.

According to the present invention there is provided a rotary engine comprising an inner element having an annular outwardly-facing circumferential surface and an outer element surrounding the inner element and having an annular inwardly-facing circumferential surface disposed opposite said circumferential surface of the inner element and concentric therewith. One of the elements is provided with at least one recess in its circumferential surface to define a gas expansion chamber and with a respective drive projection which adjoins the or each recess and which is sealed relative to the circumferential surface of the other element to serve for transmission to said one element of the pressure of gas when expanding in the adjoining chamber. A respective inlet port and exhaust port communicate with the or each chamber and bearing means mount the elements to be relatively rotatable. At least one reaction member is mounted on said other element to be movable into the or each chamber to close a flow path for gas to the associated exhaust port and to serve for transmission of the gas expansion pressure to the other element, thereby to cause opposite relative rotation of the elements, and to be movable out of such chamber by control means in order to open the flow path. One of the circumferential surfaces is of generally parabolic concave cross-sectional shape, the circumferential surfaces being disposed in close sliding fit and terminating at their extremities in spaced portions defining two circular slots.

Through formation of the circumferential surfaces as generally parabolic annular surfaces, there are no edges in the interior of the engine that have to be sealed off in circumferential direction and radial direction, so that the previously mentioned sealing problems in such an engine may be able to be avoided. By virtue of the generally parabolic cross-sectional shape of the two circumferential surfaces, these surfaces can be disposed in closer proximity than in the case of, for example, the semicircular and parallel cross-sectional shape referred to in connection with the afore-mentioned Franceschini engine. The relatively angled sides - whether straight or curved - of the generally parabolic shape have the effect that thermal expansion of the rotor and stator in the region of the circumferential surfaces acts both radially and axially of the engine to maintain the set tolerance between the surfaces.

Embodiments of the present invention will now be more particularly described by way of example with reference to the accompanying drawings, in which.

Figure 8:
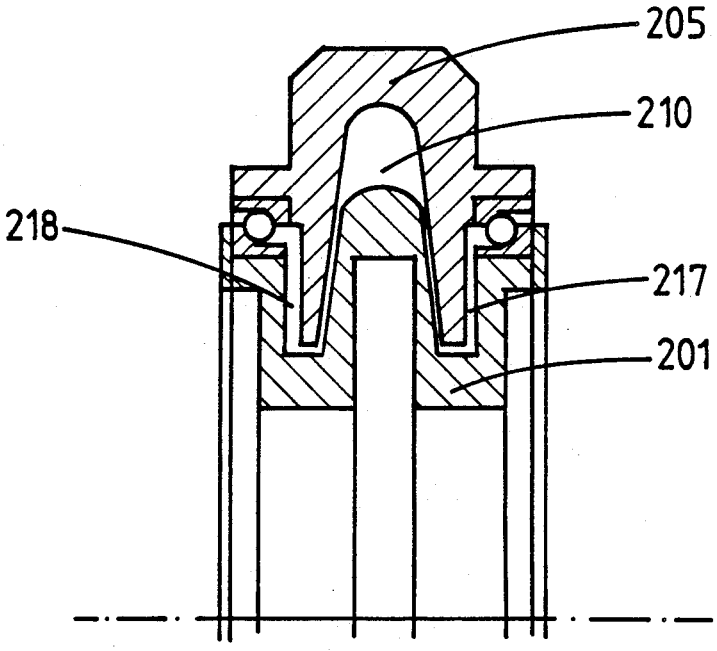
FIG. 8 is a sectional view on the plane VIII of FIG. 6.
Figure 9:
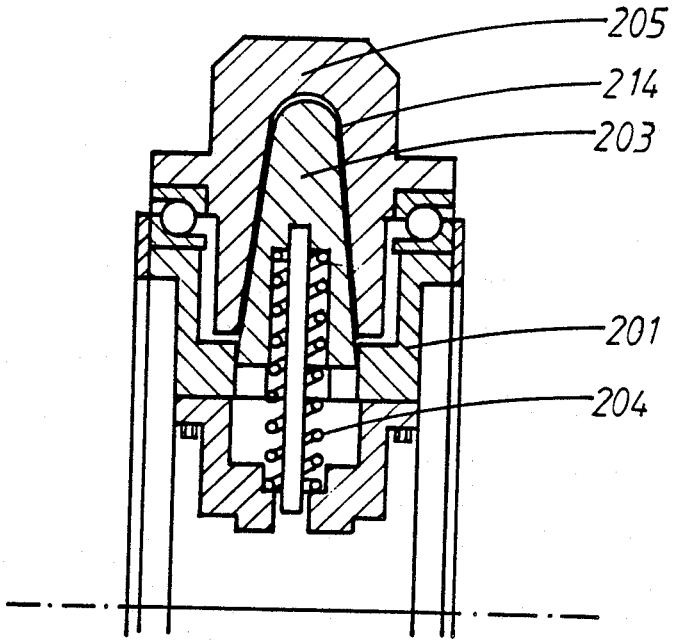
FIG. 9 is a sectional view on the plane TX of FIG. 6.
Figure 10:
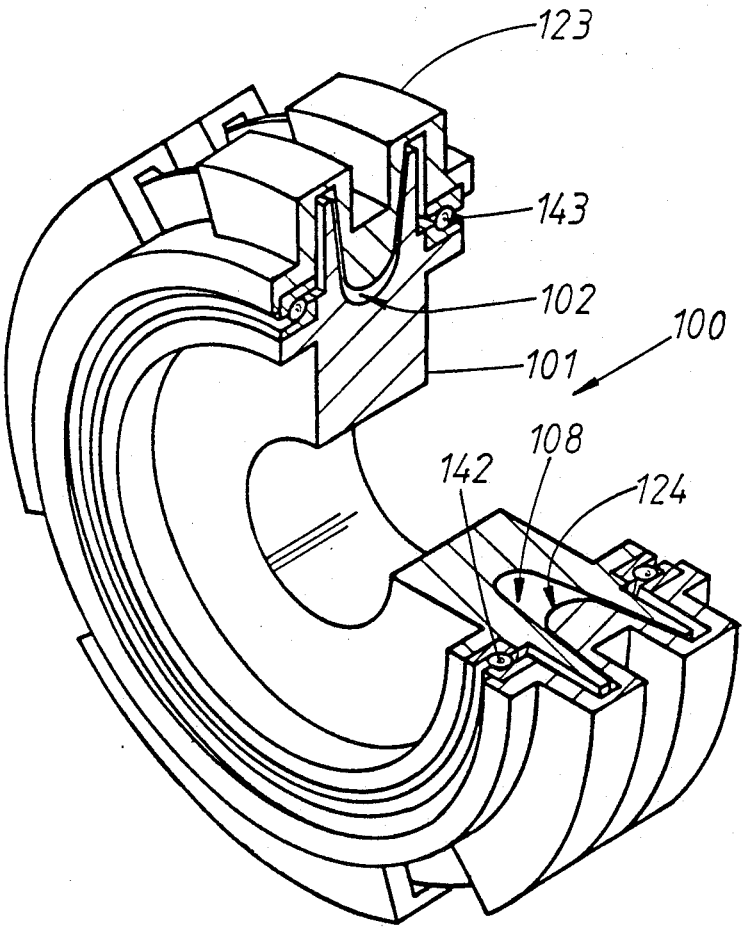
FIG. 10 is a partly broken-away perspective view of inner and outer engine elements of the engine of FIGS. 1 to 5 (reaction members omitted for clarity)
Figure 11:
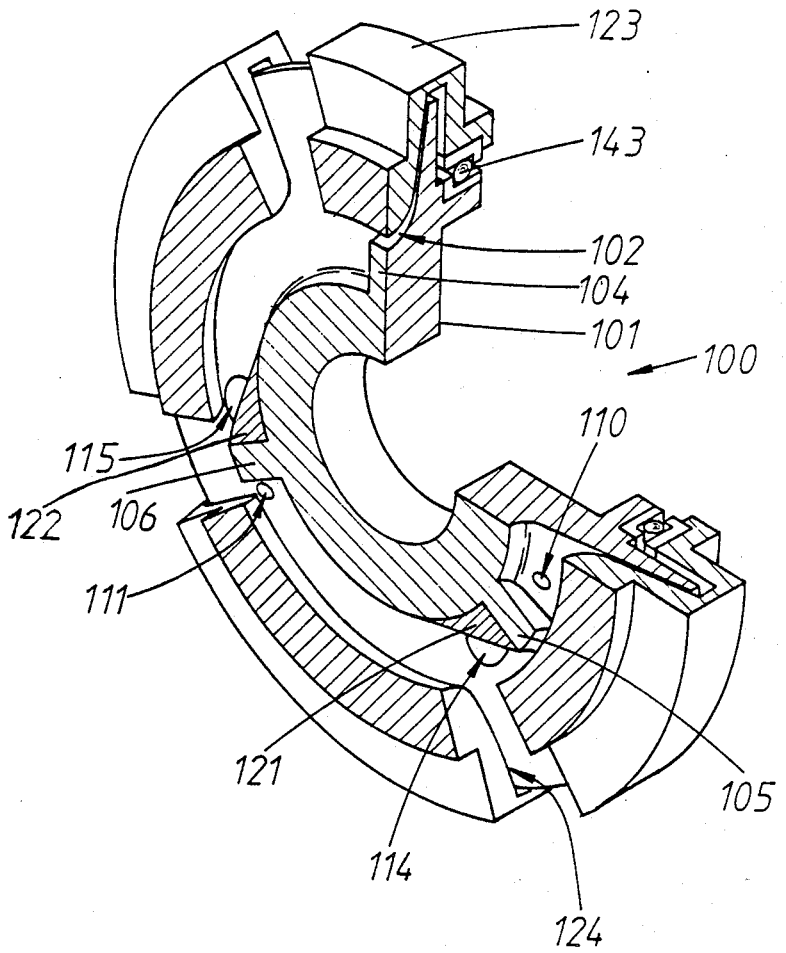
Figure 12:
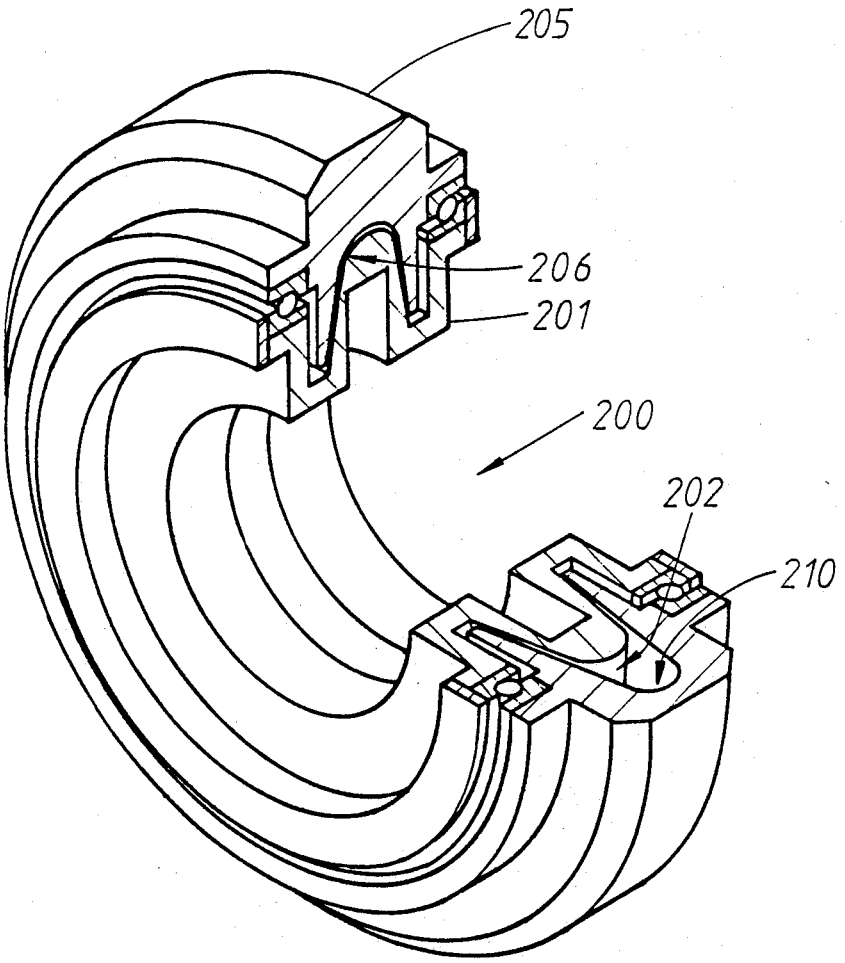
Figure 13:
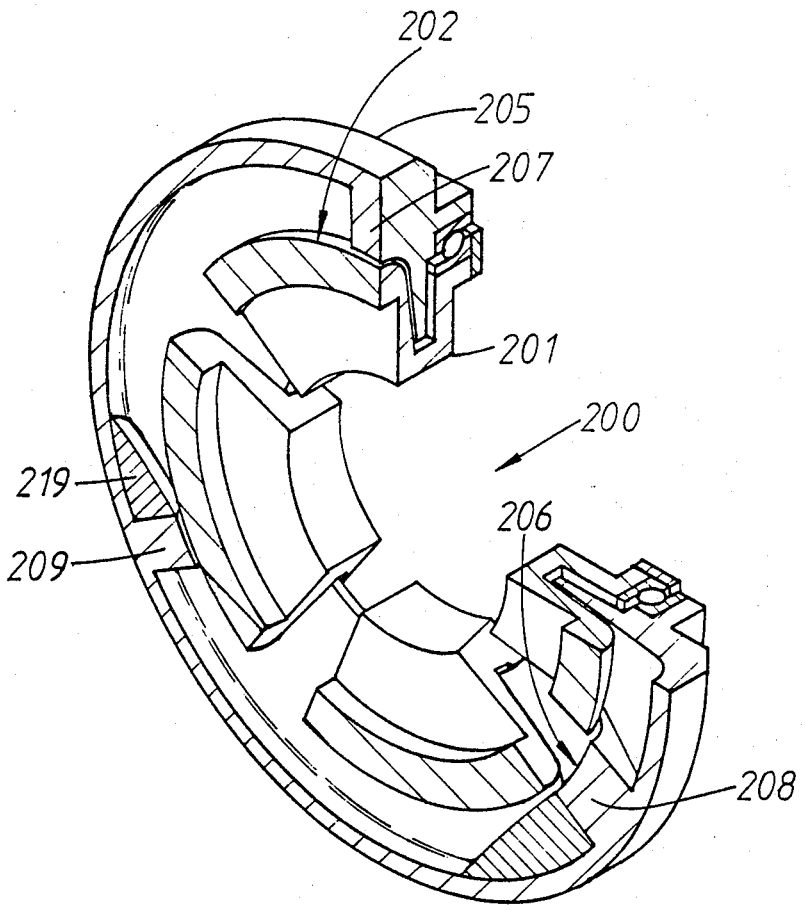

FIG. 11 is a view similar to FIG. 10, but with the inner and outer engine elements additionally sectioned in a central radial plane, FIG. 12 is a partly broken-away perspective view of the inner and outer engine elements of the engine of FIGS. 6 to 9 (reaction members omitted for clarity); and FIG. 13 is a view similar to FIG. 12, but with the inner and outer engine elements additionally sectioned in a central radial plane.

Figure 1:
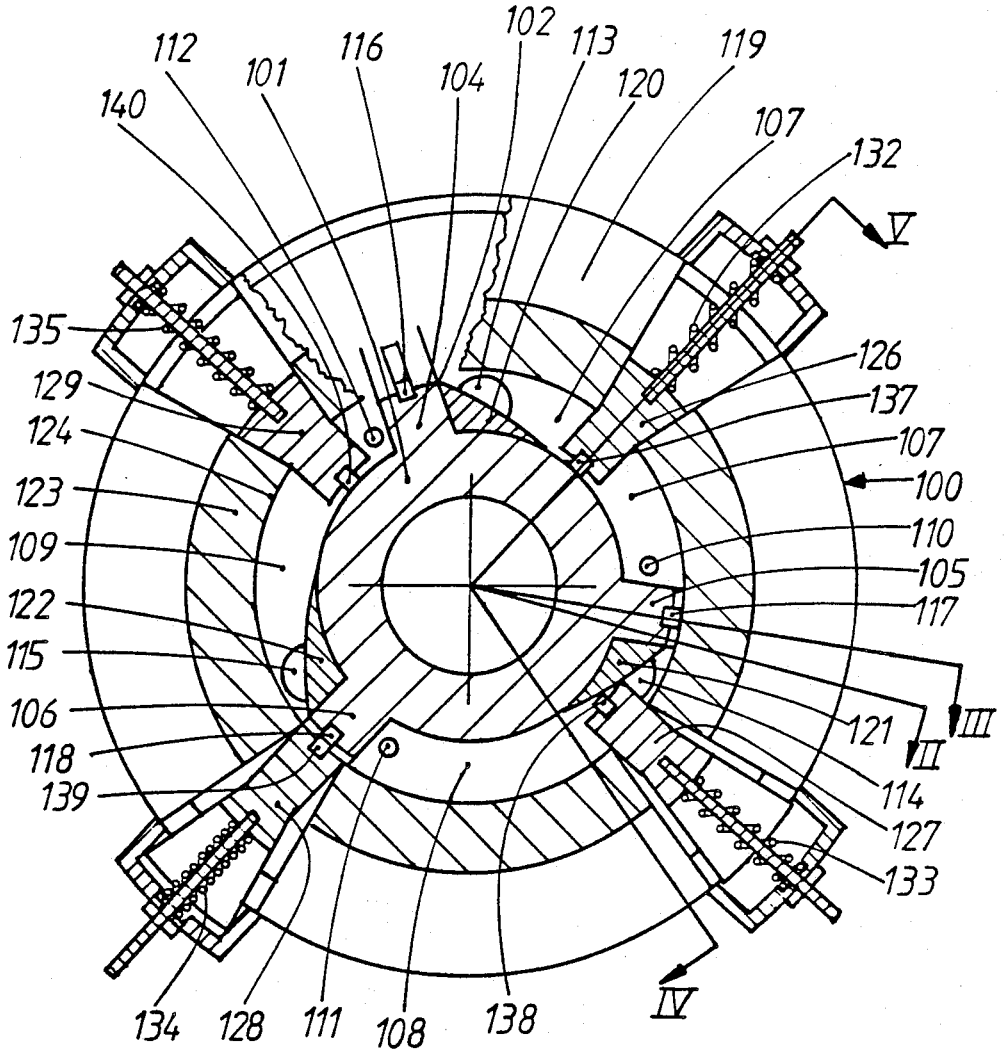
FIG. 1 is a central section, perpendicular to the engine axis and along the half center line I—I of FIG. 2, of a first rotary engine embodying the invention.
Figure 2:
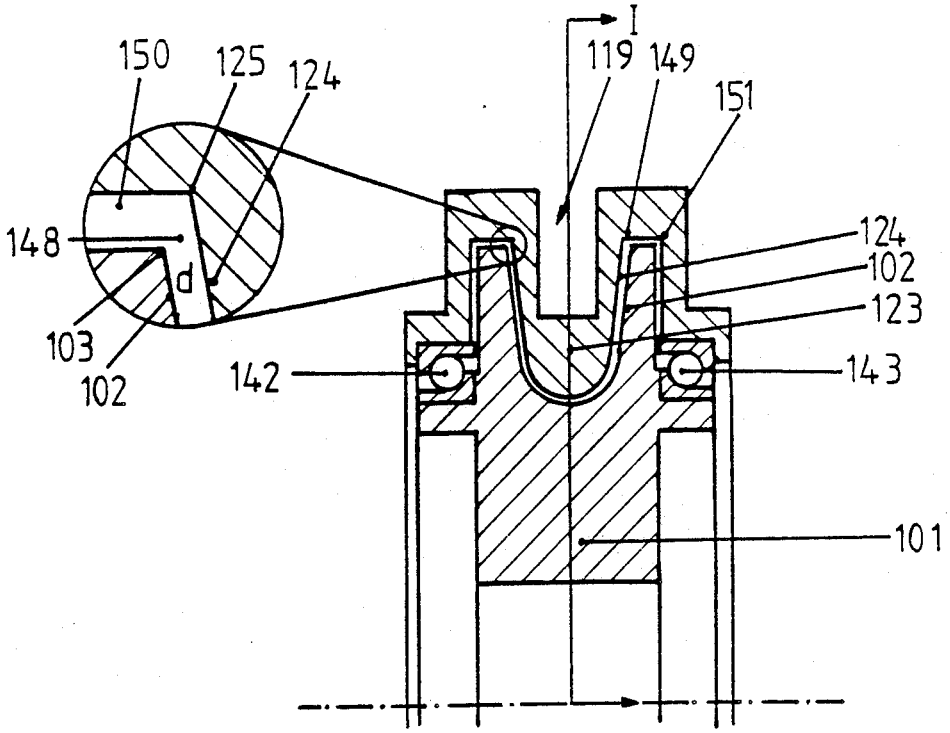
FIG. 2 is a sectional view on the plane II of FIG. 1.

Referring now to the drawings, there is shown in FIG. 1 a rotary engine 100 which comprises an inner engine element 101 with a cylinder-like outer circumferential surface 102 and an outer engine element 123, which surrounds the inner element 101 and has a cylinder-like inner circumferential surface 124, wherein the surfaces 102 and 124 are concentric and lie closely opposite each other as is evident from FIG. 2. Present in the surface 102 are segment-shaped recesses defining expansion chambers 107, 108 and 109 for a working gas driving the engine. A part of the surface 102 forms the free end of a respective projection between each two recesses, for example of the projection 104 between the recesses defining the chambers 107 and 109. In the embodiment illustrated in FIG. 1, the engine has three expansion chambers 107, 108 and 109 and thus three projections 104, 105 and 106. The chamber 107 is sealed off relative to the surface 124 in circumferential direction by a seal 116. As a result it is possible for the projection 104 to transmit the expansion pressure of the gas as a turning moment to the inner element 101. The expansion chambers 108 and 109 are sealed off in like manner by seals 117 and 118. An inlet port 110 for the gas is provided in the expansion chamber 107. Corresponding inlet ports 111 and 112 are provided in the other chambers 108 and 109.

The gas can be, for example, compressed air, water vapour, organic gas or exhaust gas conducted directly to the inlet ports 110, 111 and 112. Moreover, liquid or gaseous fuels can be combusted in an external combustion chamber with an oxidiser, for example air-oxygen, and the combustion gas introduced into the expansion chambers by way of the inlet ports. It is, however, also possible to introduce fuel through the inlet ports directly into the expansion chambers and to ignite and combust the fuel therein by way of spark plugs. Such spark plugs can, for example, be arranged—viewed in direction of rotation—in the rear sides of the projections 104, 105 and 106.

Mounted at the circumferential surface 124 of the outer element 23 are reaction members which each project into the expansion chambers in turn and transmit the expansion pressure of the gas to the outer element 123. Altogether, four such reaction members 126, 127, 128 and 129 are present at the outer element 123. The reaction members also prevent the gas from leaving the expansion chambers by way of the exhaust ports 113, 114 and 115 until the relative rotation of the engine elements 101 and 123, which has been effected by the expansion of the gas, leads to movement of the reaction members out of the way of the projections so as to free the exhaust ports. This movement of the reaction members can be achieved by arranging for the members to be pressed back, against the pressure of respective springs 132, 133, 134 and 135, into recesses 136 by control means in the form of, for example, cams 120, 121 and 122.

Figure 1A:
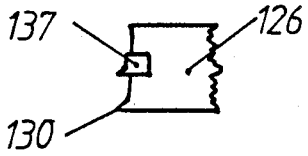
FIG. 1A is a sectional view, to an enlarged scale, of a first form of stripper edge of a reaction member of the engine.

FIG. 1A shows the edge 130, which is rearward with respect to the relative rotation of the engine elements 101 and 123, of the reaction member 126 and which can be constructed as a stripper edge to strip off deposits in the expansion chambers and convey them to the associated exhaust ports.

Figure 1B:
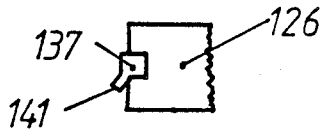
FIG. 1B is a sectional view, to an enlarged scale, of a second form of stripper edge of a reaction member of the engine.

FIG. 1B shows an alternative arrangement in which a stripper edge 141 is provided at the seal 137 in the member 126.

FIG. 2 shows an axial section of the engine 100 on the plane II of FIG. 1. It is evident from this section that the two circumferential surfaces 102 and 124 have the form of complementary annular surfaces, wherein the surface 102 in section has the shape of a concave parabola-like curve and the other surface 124 in section has the shape of a convex parabola-like curve. The expression "parabola-like curve" is to be understood as comprehending a parabola as illustrated in FIG. 2B, a parabola-like curve of the kind illustrated in FIG. 2A, and a hyperbola as illustrated in FIG. 2C. The surfaces 102 and 124 result from rotation of one such parabola-like curve around the rotational axis of the engine 1, wherein the axis of symmetry of the curve can be at any desired angle to the axis.

The two annular surfaces 102 and 124 extend parallel to each other with close sliding fit up to their outer edges 103 and 125, which define two circular slots 148 and 149. To be understood by the expression "sliding fit", which is known in the art, is that the spacing d between the edges 103 and 125 corresponds to at least the greatest of the following three values: twice the mean depth of roughness of the annular surface material, or the radial and axial throw of the surfaces 102 and 124, or the operationally effective differences in the thermal coefficients of expansion of the surfaces 102 and 124. The radial sealing of the slots 148 and 149 relative to the ambient atmosphere is additionally effected by passages 150 and 151, since the annular surface portions defined by the arms of the parabola-like curve already act as seals. In the illustrated embodiment, the passages 150 and 151 provide a single deflection of the outflow path for the gas through 180°, the width of the outermost parts of the passages being increased relative to the spacing between the circumferential surfaces 102 and 124 in the region of the edges 103 and 125. It is also possible to employ passages with multiple deflections, such as those used in turbine technology. In this case, the sealing passages can - viewed in an axial section - extend at any desired angle to the engine axis. The recess 119 in the outer element 123 serves for reception of suspension means for the reaction members and/or for cooling of the engine.

The elements 101 and 123 are mounted to be relatively rotatable by bearings 142 and 143 at both sides of the engine 100.

Figure 2A:
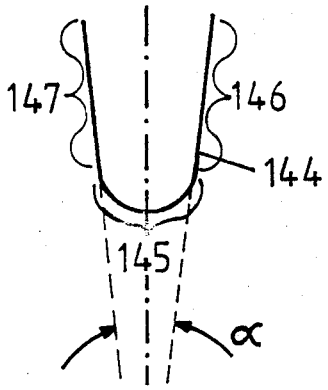
FIGS. 2A, 2B and 2C are diagrams of, respectively, a parabola-like curve, a parabolic curve and a hyperbolic curve of the shaping of complementary sealing surfaces of FIG. 1.
Figure 2B:
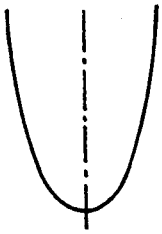
Figure 2C:
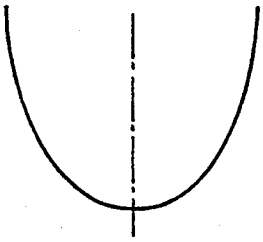

FIG. 2A shows the afore-mentioned "parabola-like" curve 144. The curve 144 consists of a circular arc 145 adjoined by two tangential straight lines 146 and 147. If the lines 146 and 147 are prolonged beyond the arc 145, then these lines include an angle = which is always smaller than 180°.

FIGS. 2B and 2C show the afore-mentioned parabolic curve and hyperbolic curve, respectively.

Figure 3:
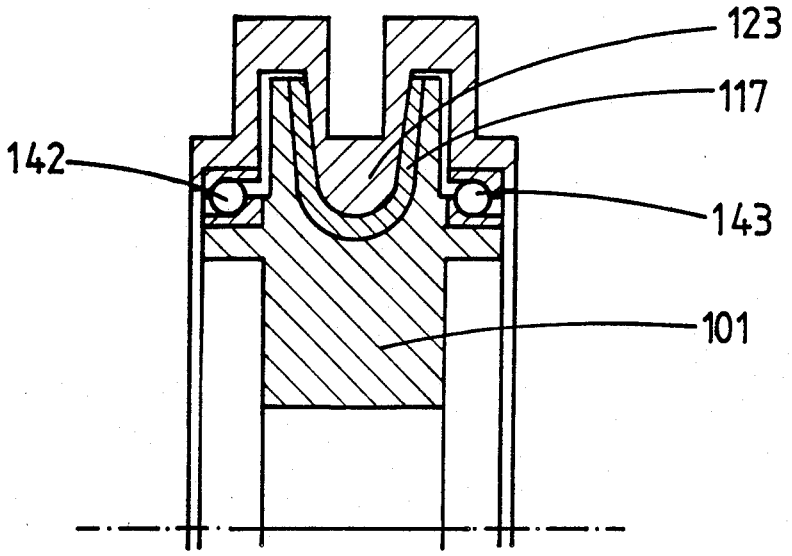
FIG. 3 is a sectional view on the plane III of FIG. 1.

FIG. 3 shows an axial section of the engine 100 in the plane III of FIG. 1. This section shows, by way of example, the seal 117 arranged in the circumferential surface 102 of the inner element 101 and sealing this surface relative to the circumferential surface 124 of the outer element 123. As a result, and as will be described in more detail in the following, the expansion chamber 107 is sealed off in the region of the projection 104. A particular property of the seal 117 is that it is practically free from wear after initial running-in, as the elements 123 and 101 rotate relative to each other free from play and with any desired accuracy by virtue of the bearings 141 and 142.

Figure 4:
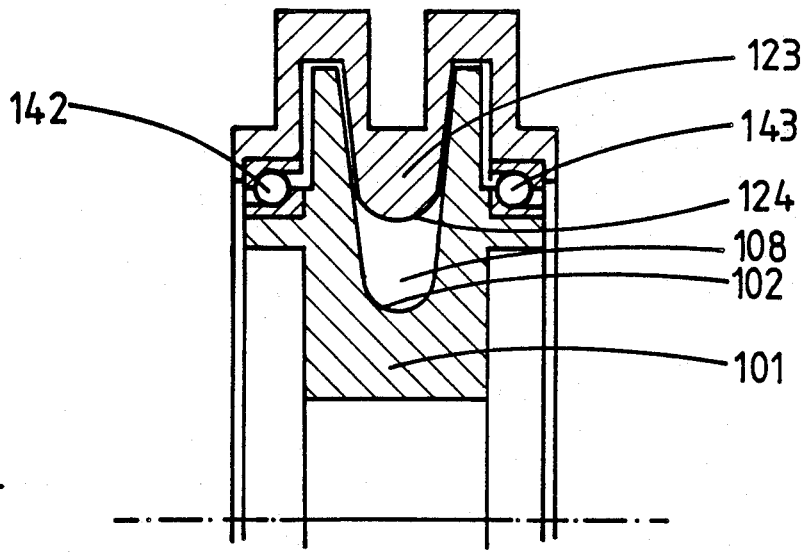
FIG. 4 is a sectional view on the plane IV of FIG. 1.

FIG. 4 shows an axial section of the engine on the plane IV of FIG. 1. FIG. 4 is thus a section through the expansion chamber 108. It is evident from FIG. 4 that the chamber 108 also has a concave shape defined by a parabola, by a parabola-like curve as illustrated in FIG. 2A, or by a hyperbola. The walls of the chamber 108 pass over continuously into the outer parts of the surface 102. The inlet port 111 for the entry of gas into the chamber 108 is disposed at one end of the chamber and the exhaust port 114 at the other end.

Figure 5:
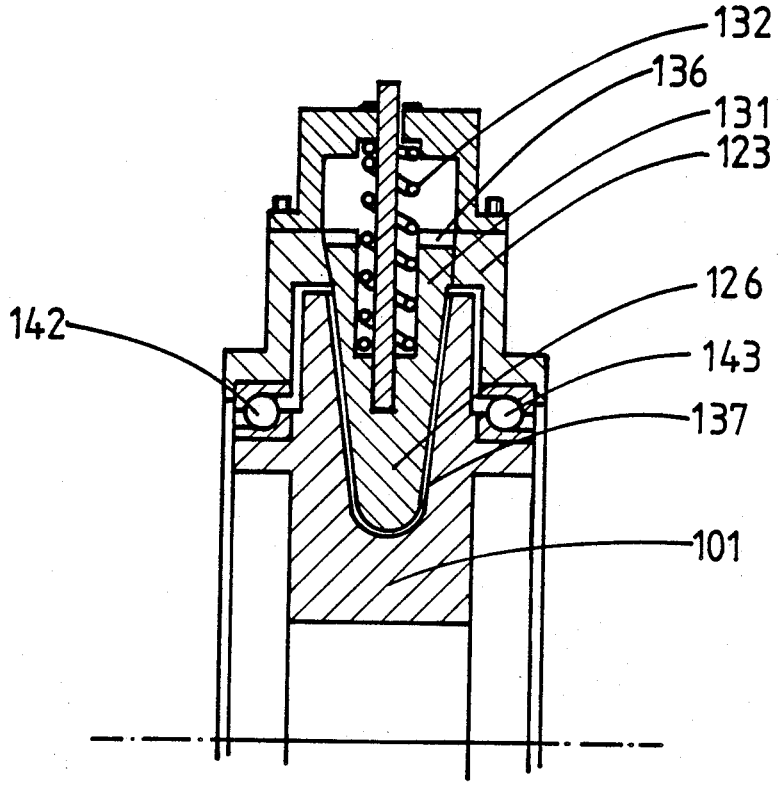
FIG. 5 is a sectional view on the plane V of FIG. 1.

In FIG. 5 there is shown an axial section on the plane V of FIG. 1. This section shows the reaction member 126 in the expansion chamber 107. The member 126 has a profile complementary to that of the wall of the chamber 107 and is sealed by a seal 137 relative to the wall of the chamber. Here, too, it is evident that there are no edges to be sealed off in circumferential direction between the member 126 and the chamber wall. Through the arrangement of the seals 116, 117 and 118 in the surface 102 and the seal 137 in the member 126, the seal 138 in the member 127 and so forth, it will be apparent that the surface 102 and the complementary surface portions of the members 126, 127, 128 and 129 can, in section, only have the shape of the afore-described parabola-like curve. This ensures that an adequate spacing between the seals 116, 117 and 118 and the seals 137, 138, 139 and 140 will immediately arise on movement of the reaction members out of the expansion chambers. If the surfaces 102 and 124 were defined at their flanks by parallel portions, then on movement of the reaction members out of the chambers the seals 116, 117 and 118 and the seals 137, 138, 139 and 140 would touch, wear and eventually shear off. The spacings 132 to 135 enable the reaction members to follow the cams 120 to 122. The head 131 of the member 132 has four substantially conical surfaces bearing against the surfaces of the respective one of the recesses 136 in the outer engine element 123.

In connection with the engine 100 shown in FIGS. 1 to 5, it is to be noted that this is illustrated with three expansion chambers, three projections and four reaction members only by way of example. The number of projections and the number of reaction members should preferably be unequal in order to avoid dead centres which would arise with equality of the numbers.

The inner element 101 can be the stator and the outer element 123 the rotor. It is, however, equally possible for the inner element 101 to be the rotor and the outer element 123 the stator. The selection of which element is to be the stator and which the rotor simply entails selection of which element is to be secured against rotation and which element is to be coupled to rotary drive output means.

Figure 6:
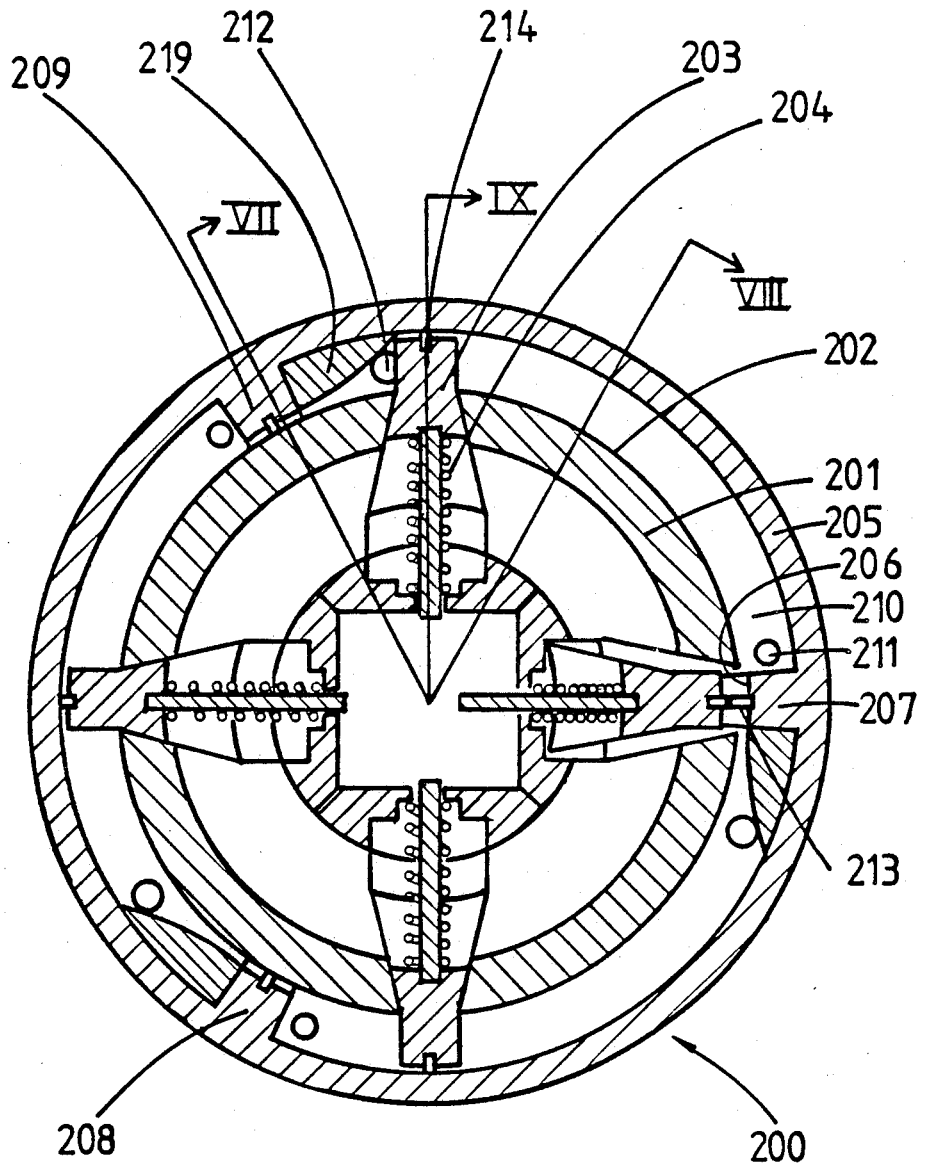
FIG. 6 is a central section, perpendicular to the engine axis along the half center line VI—VI of FIG. 7, of a second rotary engine embodying the invention.

A second embodiment of the engine is illustrated in FIGS. 6 to 9. FIG. 6 shows a section, perpendicular to the central axis and along half the centre line VI—VI of FIG. 7, of a rotary engine 200. The engine 200 comprises an inner engine element 201 with an outer circumferential surface 202, and an outer engine element 205, which surrounds the element 201 and has an inner circumferential surface 206, wherein the surfaces 202 and 206 are concentric and lie closely opposite each other and have the form of two annular surfaces, as is evident from FIG. 7. A plurality of segment-shaped recesses are provided in the surface 206 to serve as expansion chambers 210 (only one designated in FIG. 6) for the working gas. A part of the inner surface 206 remains to form the tops of projections 207, 208 and 209 between the expansion chambers. The projections are sealed by seals 213 (only one designated in FIG. 6) against the outer surface 202. Consequently, the projections can transmit the expansion pressure of the gas as a turning moment to the element 205. An inlet port 211 for the gas is provided in the chamber 210. Other inlet ports, and exhaust ports 212, are provided in like manner to those described in connection with the engine 100.

A plurality of reaction members 203 (only one designated in FIG. 6), which each project into the expansion chambers in turn and transmit the expansion pressure of the gas to the element 201, is mounted at the surface 202 of the element 201. Each of the expansion chambers is sealed by a parabola-like seal 213 (only one designated in FIG. 6) relative to the surface 202. Each reaction member 203 covers an exhaust port 212 for the expanding gas until the relative rotation of the engine elements 201 and 205, effected by the gas expansion, causes the member 203 to be moved out of the way of the approaching one of the projections 207 by means of suitable control means, for example a cam 219 associated with the projection. Each reaction member 203 is pressed by a spring 204 against either the surface 206 or the wall of the chamber 210, sealing in circumferential direction being effected by a seal 214 carried by the reaction member. The seal 214 has the same form as the seal 137.

Figure 7:
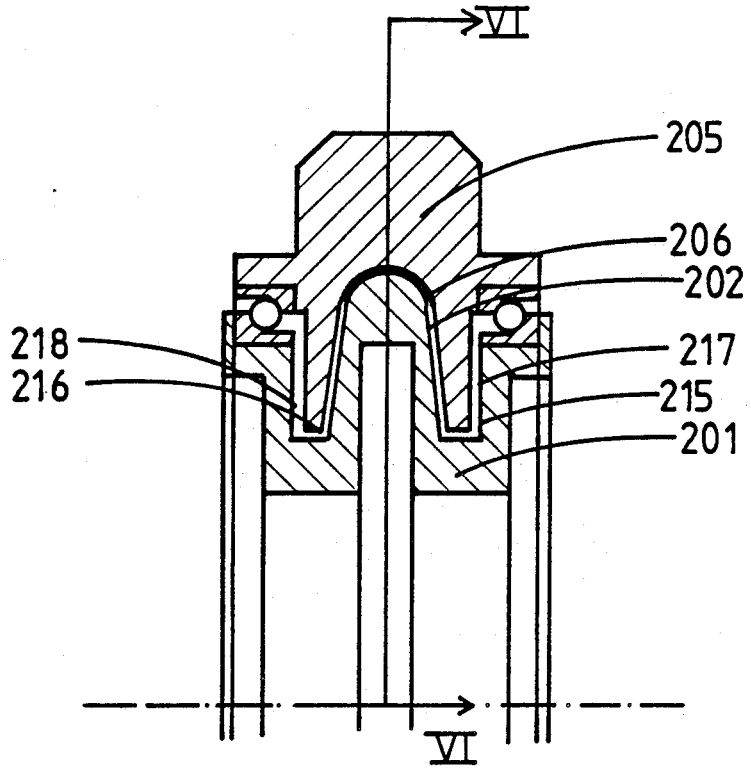
FIG. 7 is a sectional view on the plane VII of FIG. 6.

FIG. 7 shows an axial section through the engine 200 in the plane VII of FIG. 6. It is evident from this section that the surfaces 202 and 206 have the form of complementary annular surfaces, wherein the outer surface 202 has a convex shape and the inner surface 206 a concave shape defined by the afore-described parabola-like curves. The convex and concave annular surfaces 202 and 206 extend - as has been described in the foregoing—with sliding fit up to their outer edges, which define two circular slots 215 and 216. The radial sealing of the slots 215 and 216 relative to the ambient atmosphere is effected by respective sealing passages 217 and 218. These sealing passages can, if desired, contain multiple deflections.

FIG. 8 shows a second axial section of the engine 200 in the plane VIII of FIG. 6. This figure reproduces a section through an expansion chamber 210 in similar manner to FIG. 4.

FIG. 9 is an axial section of the engine 200 in the plane IX of FIG. 6. It is evident from this section that the reaction member 202 can move into the chamber 210 and is held therein by the spring 204. The sealing of the member 202 in circumferential direction against the wall of the chamber 210 is effected by the seal 214, which is shown in cross-section in FIG. 6. This seal 214 corresponds to the seal 137 of FIG. 5. The deflection of the member 203 on relative rotation of the elements 201 and 205 is effected by the cam 219 on approach of one of the projections 207.

The difference between the engine 100 and the engine 200 is basically that the outer surface 102 has the concave shape and the inner surface 124 has the convex shape in the engine 100, whilst the outer surface 202 has the convex shape and the inner surface 206 the concave shape in the engine 200.

FIGS. 10 and 11 are partly broken-away sectional views of the inner and outer elements 101 and 123 of the engine 100 in perspective, illustrating the configuration of the complementary circumferential surfaces 102 and 124 of these elements. The engine is shown in FIG. 10 sectioned in positions similar to those of FIGS. 2 and 4. Also designated in FIG. 10 are the bearings 142 and 143 mounting the elements 101 and 123 for relative rotation, and part of the expansion chamber 108. FIG. 11 corresponds to FIG. 10, but with an additional section in the same central radial plane of the engine as that of FIG. 1. Additionally designated in FIG. 11 are the projections 104, 105 and 106, the inlet ports 110 and 111, the exhaust ports 114 and 115, and the cams 1231 and 122.

FIGS. 12 and 13 are views similar to FIGS. 10 and 11, but relating to the engine 200. FIGS. 12 and 13 thus constitute partly broken-away and sectional views of the inner and outer elements 201 and 205 and illustrate the configuration of the complementary circumferential surfaces 202 and 206. Also designated are part of the expansion chamber 210, the projections 207, 208 and 209, and one of the cams 219.

Through application of the afore-described principles with respect to the form of the circumferential surfaces, the expansion chambers, the reaction members and the sealing of these parts relative to each other in circumferential direction as well as from the ambient atmosphere, an engine of improved efficiency, in particular with respect to sealing, is achieved.

I claim:

1. A rotary engine comprising an inner element having an outwardly-facing circumferential surface, an outer element surrounding the inner element and having an inwardly-facing circumferential surface disposed opposite said circumferential surface of the inner element and concentric therewith, one of said inner and outer elements being provided with at least one recess in said circumferential surface thereof to define a gas expansion chamber and with a respective drive projection which adjoins said at least one recess and which is sealed relative to said circumferential surface of the other element to serve for transmission to said one element of the pressure of gas when expanding in the adjoining chamber, means defining an inlet port and an exhaust port respective to and communicating with said chamber, bearing means mounting the elements to be relatively rotatable, at least one reaction member mounted on said other element to be movable into said chamber to close a flow path for gas to the associated exhaust port and to serve for transmission of said gas expansion pressure to said other element thereby to cause opposite relative rotation of the elements and to be movable out of such chamber to open said flow path, and control means to cause said movement of said at least one reaction member out of said chamber, wherein one of said circumferential surfaces is of generally parabolic concave cross-sectional shape and the other of complementary, generally parabolic convex cross-sectional shape, wherein said circumferential surfaces are disposed in close sliding fit, and wherein said generally parabolic concave cross-sectional shape and said generally parabolic convex cross-sectional shape are each defined in cross-section by a curve and by two lines which each extend from a respective end of said curve and which diverge from each other in a direction away from said curve.

2. An engine as claimed in claim 1, wherein each of said circumferential surfaces is defined in cross-section by a parabola.

3. An engine as claimed in claim 1, wherein each of said circumferential surfaces is defined in cross-sectional by a hyperbola.

4. An engine as claimed in claim 1, wherein each of said circumferential surfaces is defined in cross-section by an arc of a circle and by two straight lines extending divergently one from each end of the arc and tangent to the circle of such arc.

5. An engine as claimed in claim 1, wherein said one of the elements is provided with a plurality of such recesses and said circumferential surface thereof is the surface of generally parabolic concave cross-sectional shape, each recess being in the form of a concave depression in a concave base of that circumferential surface and being bounded at its circumferentially spaced ends by two such drive projections and closed off radially outwardly by a convex portion of the circumferential surface of generally parabolic convex cross-sectional shape.

6. An engine as claimed in claim 1, comprising seals mounted in said one circumferential surface and slidably bearing against said other circumferential surface thereby to seal off said expansion chamber at its circumferentially spaced ends.

7. An engine as claimed in claim 6, wherein each of the seals is disposed in a respective plane extending radially of an axis of relative rotation of said elements.

8. An engine as claimed in claim 1, wherein the elements include mutually facing surfaces respectively connecting with said circumferential surfaces at the outermost extremities thereof and defining passages at the sides of the engine.

9. An engine as claimed in claim 8, wherein the width of each of the passages in cross-section is increased relative to the spacing between said circumferential surfaces in the regions thereof adjoining said extremities.

10. An engine as claimed in claim 6, wherein the seals are generally parabola-shaped.

11. An engine as claimed in claim 1, wherein said at least one reaction member is mounted in the element with the circumferential surface of generally parabolic convex cross-sectional shape and projects into said expansion chamber by way of an opening in that surface, said at least one reaction member having a portion which is substantially complementary in cross-sectional shape to that of said at least one recess.

12. An engine as claimed in claim 11, comprising a seal arranged between said at least one reaction member and surface means defining said at least one recess.

13. An engine as claimed in claim 11, wherein said at least one reaction member is provided at said portion thereof with a stripper edge for removing deposited material from said recess.

14. An engine as claimed in claim 11, wherein said portion of said at least one reaction member is disposed in sealing engagement with surface means defining said at least one recess.

* * * * *